US005312108A

United States Patent [19]

Hayashi

[11] Patent Number: 5,312,108

[45] Date of Patent: May 17, 1994

[54] PAPER DISCHARGE DEVICE

[75] Inventor: Takayuki Hayashi, Nagoya, Japan

[73] Assignee: Brother Kogyo Kabushiki Kaisha, Nagoya, Japan

[21] Appl. No.: 21,552

[22] Filed: Feb. 24, 1993

[30] Foreign Application Priority Data

Apr. 10, 1992 [JP] Japan ..... 4-30751

[51] Int. Cl.[5] ..... B65H 29/70

[52] U.S. Cl. ..... 271/188; 271/314

[58] Field of Search ..... 271/188, 209, 161, 314

[56] References Cited

U.S. PATENT DOCUMENTS

| | | | |
|---|---|---|---|
| 2,796,259 | 6/1957 | Fawcett | 271/188 |
| 4,059,203 | 11/1977 | Wright | 271/188 |
| 4,350,332 | 9/1982 | Knight | 271/188 |
| 4,717,938 | 1/1988 | Tanio | 271/188 |

FOREIGN PATENT DOCUMENTS

| | | | |
|---|---|---|---|
| 0203053 | 11/1984 | Japan | 271/188 |
| 0028161 | 1/1989 | Japan | 271/188 |
| 0204242 | 8/1990 | Japan | 271/188 |

*Primary Examiner*—H. Grant Skaggs
*Attorney, Agent, or Firm*—Oliff & Berridge

[57] ABSTRACT

A central paper discharge roller is disposed on a shaft so as to come in contact with the center of the paper to be discharged. An outer paper discharge roller is disposed on either side of the central paper discharge roller at a predetermined interval. The diameter of the central paper discharge roller is greater than that of the outer paper discharge rollers. A plurality of ribs which press the paper against the paper discharge rollers are disposed on a rib panel. With this structure, the paper discharge device can discharge the paper without generating crinkles in the paper.

22 Claims, 7 Drawing Sheets

PAPER DISCHARGE DEVICE

BACKGROUND OF THE INVENTION

1. Field of the Invention

The present invention relates to a paper discharge device which is incorporated into a print device. More particularly, the present invention is drawn to a paper discharge device which can discharge a paper from the print device while preventing the paper from getting out of position and can prevent the generation of crinkles in the paper.

2. Description of Related Art

A conventional paper discharge device incorporated into a print device discharges a paper by temporarily providing a corrugation-like fold to the paper, as shown in FIG. 6. Temporarily bending paper so that the bends run in the direction parallel to the feeding direction of the paper is referred to as corrugating. Therefore, if the paper is fed in the longitudinal direction, the paper is corrugated in the transverse direction thereof. Corrugating is used to ensure that the paper is fed straight toward the feeding direction and does not get out of position. The typical example of the above-mentioned paper discharge device is shown in FIGS. 5 and 6.

FIG. 5 is a sectional view of a print device 100 in which the conventional paper discharge device is installed. The print device 100 generally comprises a paper supply portion 110, a print portion 120 and a paper discharge portion 130. The paper supply portion 110, the print portion 120 and the paper discharge portion 130 are arranged in the vertical direction so they are not arranged in a straight line. Therefore, the capacity and the projection area of the print device 100 is small.

The paper supply portion 110 comprises a paper cassette 112 and a paper feeding portion (not shown). The paper cassette 112 can store papers having various sizes. The paper cassette 112 is detachably installed into the print device 100 through a cassette installation entrance 106 formed on a device frame 102.

The print portion 120 comprises a common print means, such as wire dot heads, thermal heads, ink jet heads, and the like.

FIG. 6 is a front view of the conventional paper discharge device. The paper discharge portion 130 comprises a rib panel 131, ribs 132, a rotational shaft 134, paper discharge rollers 136, a paper empty sensor 138 and a paper discharge tray 140.

The paper discharge tray 140 is provided, either integrally or detachably, on the device frame 102. The paper discharge tray 140 can stack and store many papers A which are discharged from a paper discharge outlet 104 formed on the device frame 102. Moreover, the paper discharge tray 140 is disposed with an inclination such that the paper A is stacked upwardly. Accordingly, many discharged papers A can be stored.

The three paper discharge rollers 136 are fixedly disposed on the rotational shaft 134. The rotational shaft 134 is rotated at a predetermined velocity by a driving source (not shown). As shown in FIG. 5, the paper discharge roller 136 rotate counterclockwise as the rotational shaft 134 rotates. One paper discharge roller 136 is disposed near the center of the rotational shaft 134. The other two paper discharge rollers 136 are each disposed on either side of the center paper discharge roller 136 on the rotational shaft 134 and spaced at a predetermined interval from the center paper discharge roller 136. The center paper discharge roller 136 is disposed so as to come in contact near the center portion of the paper A. Accordingly, even if the size of the paper A is changed, at least the center paper discharge roller 136 comes into contact with the paper A. Therefore, papers A having various sizes can be discharged efficiently by a minimum number of the paper discharge rollers 136.

The ribs 132 are disposed integrally on a rib panel 131. The ribs 132 press the paper A against the paper discharge rollers 136. Moreover, in the convention device, four ribs 132 having the same length are disposed on the rib panel 131. Each paper discharge roller 136 is disposed near the center of the interval between two adjacent ribs 132.

The paper empty sensor 138 detects whether the paper A has discharged. The paper empty sensor 138 is disposed on the rib panel 131 in the vicinity of the center paper discharge roller 136.

Next, the operation of the print device 100 will be explained with reference to FIGS. 5–6. When the print device 100 receives the print command from the host computer (not shown), the paper feeding portion takes up one paper A from the paper cassette 112, and feeds the paper A toward the paper discharge portion 130. Then, the three paper discharge rollers 136 disposed on the rotational shaft 134 rotate when the shaft 136 is rotated by a driving source (not shown). The paper discharge rollers 136 and the ribs 132 corrugate the paper A in the direction perpendicular to the feeding direction of the paper A. The corrugation effect is caused by the cooperative relation of the rollers 136 with the ribs 132. Accordingly, the paper A takes a W-like shape. That is, the center portion of the paper A becomes the top of the corrugation. Under this condition, the paper A is discharged onto the paper discharge tray 140.

In the conventional paper discharge device as shown in FIG. 5, the paper A is fed counterclockwise from the paper supply portion 110 toward the paper discharge portion 130 through the print portion 120. Therefore, just before the paper A reaches the paper discharge portion 130, the paper A is curved convexly with respect to the feeding direction of the paper. But, as described above, the paper A which is curved convexly is corrugated in the paper discharge portion 130 such that the paper A takes a W-like shape in the direction perpendicular to the feeding direction of the paper A. Accordingly, the paper A is crinkled. Especially, crinkles usually occur on the bottom portion of the W-like shape.

SUMMARY OF THE INVENTION

It is therefore an object of the present invention to provide a paper discharge device which can discharge a paper from the print device so as not to allow the paper to get of position, and without crinkling the paper.

To achieve this object, a paper discharge device of the present invention comprises a rotational shaft which is driven so as to rotate in order to discharge a paper, at least three paper discharge rollers disposed on the rotational shaft in the longitudinal direction of the rotational shaft and a pressure member for pressing a paper against the rotational shaft, the diameter of the outer paper discharge roller being smaller than that of the central paper discharge roller, so that the paper which is sandwiched between the pressure member and the paper discharge rollers is curved convexly in the wide direction of the paper such that the center portion of the paper gets the top of the convexity.

According to the paper discharge device of the present invention having the above-mentioned structure, the paper is curved convexly with respect to the feeding direction until the paper reaches the paper discharge device. After this, the paper is curved convexly with respect to the direction perpendicular to the feeding direction (the wide direction of the paper) such that the center line of the paper gets the top line of the convexity. However, this change of the curve is executed smoothly. Since, the paper which is discharged from the print device of the present invention is not forcibly corrugated.

BRIEF DESCRIPTION OF THE DRAWINGS

A preferred embodiment of the present invention will be described in detail with reference to the following figures wherein.

DETAILED DESCRIPTION OF THE PREFERRED EMBODIMENTS

Hereinafter, the preferred embodiments of the present invention will be explained with reference to the figures. First, the structure of a print device of the first preferred embodiment will be explained with reference to FIGS. 1 and 2.

Figure 5:
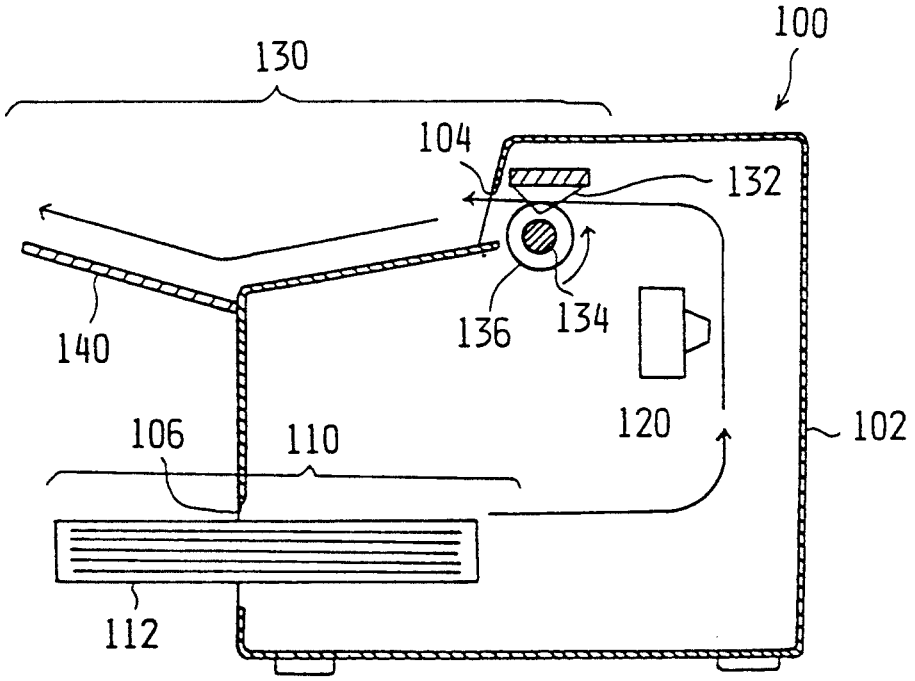
Fig.5 RELATED ART
FIG. 5 is a schematic construction view of a print device having the conventional paper discharge device.

A print device 1 has essentially the same structure as the conventional print device 100 shown in FIG. 5. The print device 1 generally comprises a paper supply portion 10, a print portion 20 and a paper discharge portion 30 which are arranged along the feeding passage of a paper.

The paper supply portion 10 comprises a paper cassette 6 and a paper feeding portion (not shown). The paper cassette 6 can store papers having various sizes. It is detachably installed into the print device 1 through a cassette installation entrance 5 formed on a device frame 2. When the paper feeding portion (not shown) receives the print command, the paper feeding portion takes up one paper after another from the paper cassette 6, and feeds the paper toward the print portion 20.

The print portion 20 has the same structure as the print portion 120 described above. The print portion 120 executes a print operation for the paper fed from the paper feeding portion. The paper printed in the print portion 20 is further fed toward the paper discharge portion 30.

Figure 1:
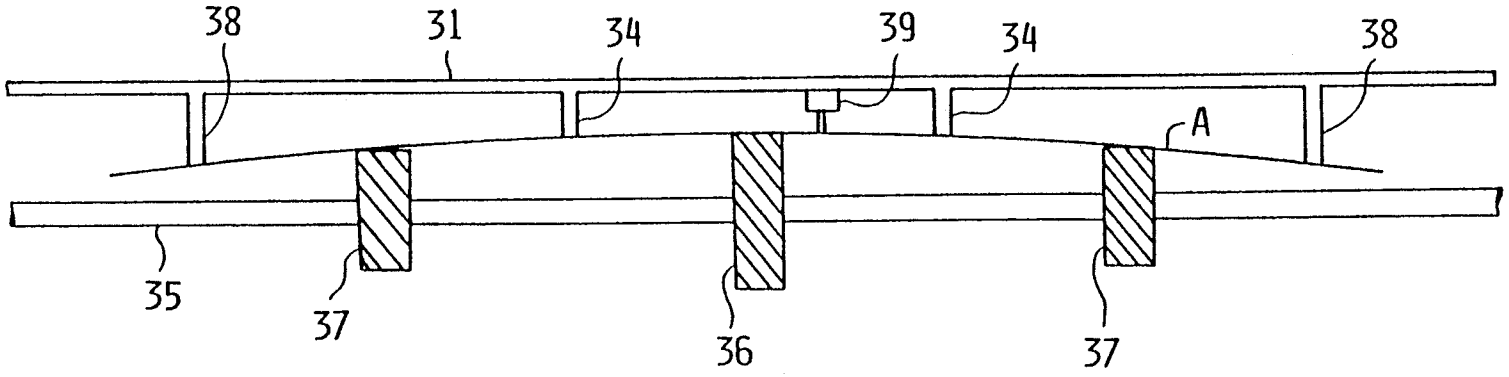
FIG. 1 is a front view of a paper discharge device of the first preferred embodiment of the present invention.
Figure 2:
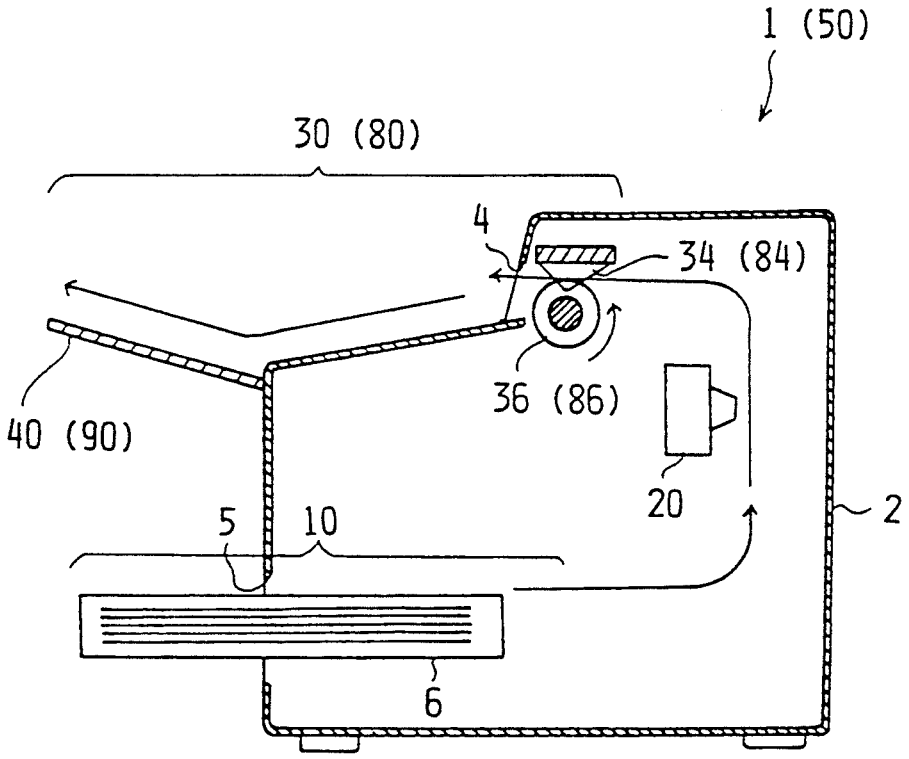
FIG. 2 is a schematic construction view of a print device having the paper discharge device of the first and second embodiments of the present invention.

As shown in FIGS. 1 and 2, the paper discharge portion 30 (paper discharge device) comprises ribs 34 and 38, rib panel 31, a rotational shaft 35, paper discharge rollers 36 and 37, a paper empty sensor 39 and a paper discharge tray 40.

The paper discharge tray 40 is provided integrally on the device frame 2 or is provided detachably on the device frame 2. The paper discharge tray 40 stacks and stores the paper A which is discharged from a paper discharge entrance 4 formed on the device frame 2.

The paper discharge rollers 36 and 37 are fixedly disposed on the rotational shaft 35. The diameter of the inner or central paper discharge roller 36 is larger than that of each outer paper discharge roller 37. The rotational shaft 35 is rotated at a predetermined rate by a driving source (not shown). As shown in FIG. 2, the paper discharge rollers 36 and 37 rotate counterclockwise as the rotational shaft 35 rotates. The central paper discharge roller 36 is positioned on or near the center of the rotational shaft 35. The two outer paper discharge rollers 37 are respectively disposed on either side of the central paper discharge roller 36 and spaced at a predetermined interval from the central paper discharge roller 36.

The ribs 34 and 38 are provided integrally on the rib panel 31 and press the paper A against the paper discharge rollers 36 and 37. The length of the inner or central ribs 34 is shorter than that of the outer ribs 38. Moreover, in the first embodiment, two central ribs 34 and two outer ribs 38 are provided and the central paper discharge roller 36 is disposed at or near the center of the space between the two central ribs 34. Moreover, the two outer paper discharge rollers 37 are respectively disposed at or near the center of the spaces between the two central ribs and between each of the central ribs 34 and the adjacent outer rib 38.

Figure 6:
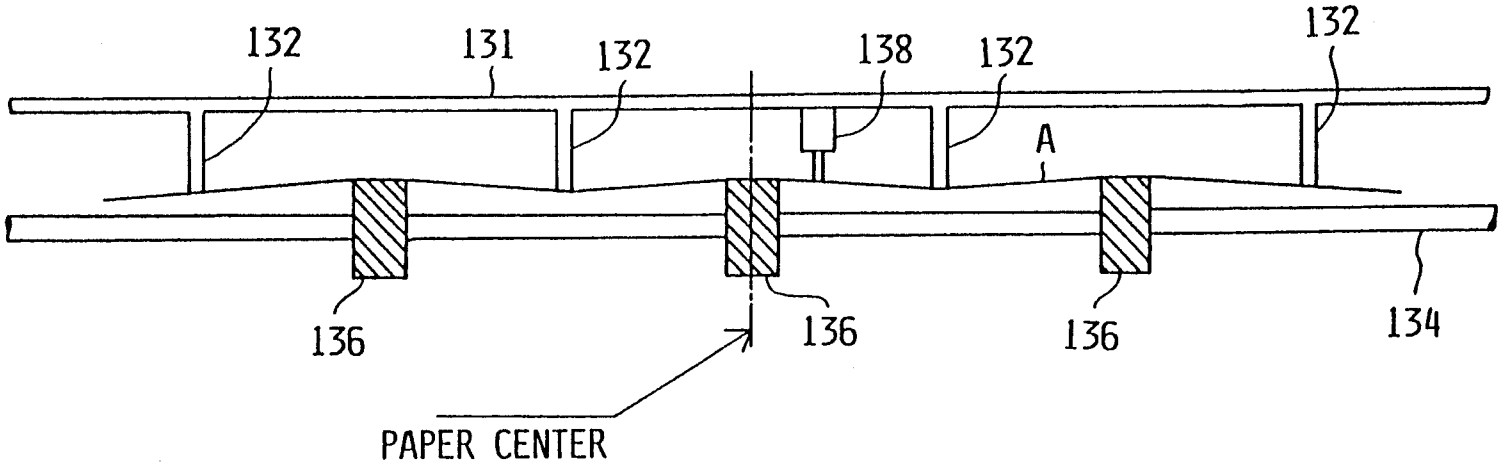
Fig.6 RELATED ART
FIG. 6 is a front view of the conventional paper discharge device.

The function of the paper empty sensor 39 is similar to that of the paper empty sensor 138 shown in FIG. 6. Moreover, the paper empty sensor 39 is disposed on the rib panel 31 in the vicinity of the central paper discharge roller 36.

Next, an operation of the print device 1 incorporating the paper feeding device of the first preferred embodiment will be described with reference to FIGS. 1 and 2.

The print device 1 is connected to a host computer or the like (not shown). When the host computer outputs the print command, a control part of the printing device 1 (not shown) starts the printing operation of the print device 1. When the control part receives the print command from the host computer, the control part controls the paper feeding portion 10 such that one paper is taken up from the paper cassette 6 and is fed toward the print portion 20. Further, the control part controls the print portion 20 such that the paper A is printed. After this, the paper A is fed toward the paper discharge portion 30.

When the paper A is discharged from the paper discharge portion 30, the paper A is pressed against the central paper discharge roller 36 and the outer paper discharge rollers 37 by the central ribs 34 and the outer ribs 38. The diameter of the central paper discharge roller 36 is larger than that of each outer paper discharge roller 38. Further, the length of the central ribs 34 is shorter than that of the outer ribs 38. Therefore, the paper A is discharged so as to be curved convexly with respect to the direction perpendicular to the feeding direction of the paper. That is, the paper A is curved such that the center of the paper A is at the top of the convexly curved paper. Under this condition, the paper A is discharged as the rotational shaft 35 rotates. Just before the paper A is discharged from the paper discharge portion 30, the paper A is curved convexly with the feeding direction of the paper. However, the change in the direction of curvature in the discharge portion 30 does not affect the paper A. Therefore, the paper A can be discharged from the paper discharge portion without generating crinkles in the paper A.

Next, a structure of print device 50 incorporating a paper discharge device of the second preferred embodiment will be described with reference to FIGS. 2, 3A and 3B.

The structure of the print device 50 of the second preferred embodiment is identical to that of the print device 1 of the first preferred embodiment except for the paper discharge device. Hereinafter, the structure of the paper discharge device of the second embodiment will be explained.

Figure 3A:
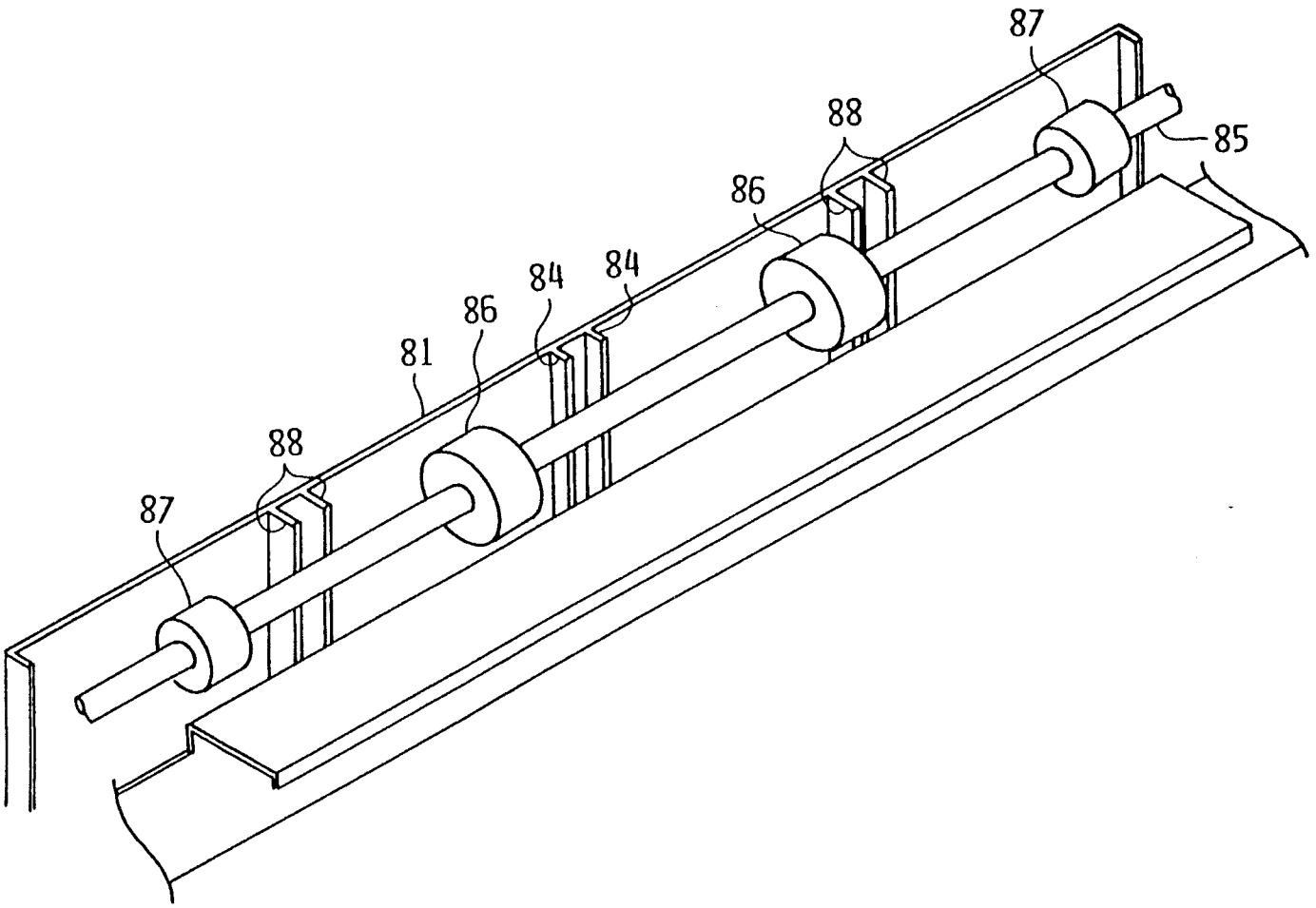
FIG. 3A is a perspective view of the paper discharge device of the second preferred embodiment of the present invention.
Figure 3B:
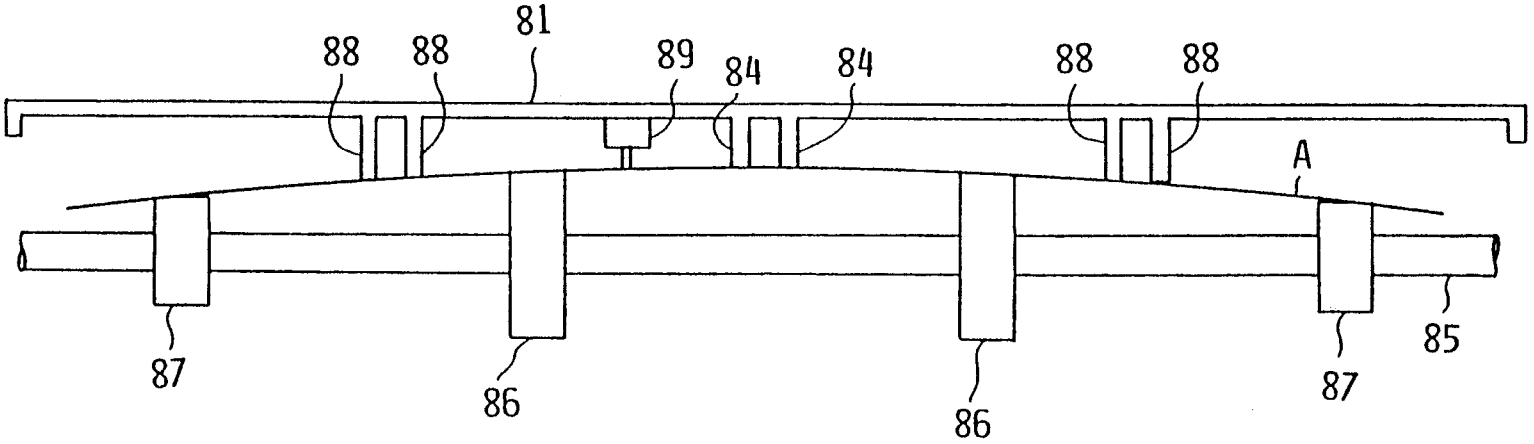
FIG. 3B is a front view of the paper discharge device of the second preferred embodiment of the present invention.

As shown in FIGS. 3A and 3B, a paper discharge portion 80 (paper discharge device) comprises inner or center ribs 84 and outer ribs 88, a rib panel 81, a rotational shaft 85, inner or central paper discharge rollers 86 and outer discharge rollers 87, a paper empty sensor 89 and a paper discharge tray 90.

The paper discharge tray 90 is disposed integrally on the device frame 2 or is disposed detachably on the device frame 2. The paper discharge tray 90 stacks and stores a paper A discharged from the paper discharge outlet 4 provided on the device frame 2.

The two central paper discharge rollers 86 and the two outer paper discharge rollers 87 are fixedly disposed on the rotational shaft 85. The diameter of the central paper discharge rollers 86 is larger than that of the outer paper discharge rollers 87. The rotational shaft 85 is rotated at a predetermined rate by a driving source (not shown). As indicated by an arrow of FIG. 2, the paper discharge rollers 86 and 87 rotate counterclockwise with the rotational shaft 85. The two central paper discharge rollers 86 are spaced away from each other on the rotational shaft 85 at a predetermined interval from the center point of the rotational shaft 84. Further, each outer paper discharge roller 87 is disposed on the rotational shaft 85 at a predetermined interval outwardly from one of the central paper discharge rollers 86.

The ribs 84 and 88 are provided integrally on the rib panel 81, and press the paper A against the paper discharge rollers 86 and 87. The length of the central ribs 84 is shorter than that of the outer ribs 88. Moreover, in the present embodiment, two ribs 84 and four ribs are disposed as one pair of ribs 84 and two pair of ribs 88. Each central paper discharge roller 86 is disposed at or near the center of the space between the pair of ribs 84 and one of the pairs of ribs 88. Each outer paper discharge roller 87 id disposed at or near the center of the interval between one of the pairs of ribs 88 and one end of the rib panel 81.

The function of the paper empty sensor 89 is similar to that of the paper empty sensor 39 shown in FIG. 1. The paper empty sensor 89 is disposed on the rib panel 81 in the vicinity of the paper discharge roller 86.

Next, operation of the print device 50 incorporating the paper feeding device of the second preferred embodiment will be explained with reference to FIGS. 2, 3A and 3B.

The print device 50 is connected to a host computer or the like (not shown). When the host computer outputs the print command, a control part of the print device 50 (not shown) starts the printing operation of the print device 50. When the control part receives the print command from the host computer, the control part controls the paper feeding portion 10 such that one paper is taken up from the paper cassette 6 and is fed toward the print portion 20. Further, the control part controls the print portion 20 such that the paper A is printed. After this, the paper A is fed toward the paper discharge portion 30. At this time, the paper A is fed so as to be curved convexly with respect to the feeding direction of the paper A.

When the paper A reaches the paper discharge portion 80, the paper A is pressed against the central paper discharge rollers 86 and the outer paper discharge rollers 87 by the central ribs 84 and the outer ribs 88. The diameter of the central paper discharge roller 86 is larger than that of the outer paper discharge rollers 88. Further, the length of the central ribs 84 is shorter than that of the outer ribs 88. Therefore, the paper A is curved convexly with respect to the direction perpendicular to the feeding direction (wide direction of the paper). That is, the paper A is curved such that the center of the paper A is at the top of the convexly curved paper. Under this condition, the paper A is discharged as the rotational shaft 85 rotates. Just before the paper A is discharged from the paper discharge portion 30, the paper A is curved convexly with the feeding direction of paper. However, the change in the direction of curvature in the discharge portion 30 does not affect the paper A. Therefore, the paper A can be discharged from the paper discharge device without generating crinkles in the paper A.

As described above, in the second preferred embodiment of the paper discharge device of the present invention, the diameter of the paper discharge roller which is disposed at or near the center of rotational shaft is larger than that of the outer paper discharge rollers. Further, the length of the ribs disposed at or near the canter of the rib panel is shorter than that of the outer ribs. Accordingly, the paper does not crinkle in the above-mentioned simple structure.

This invention is not limited to the above mentioned embodiment. It should be understood that many changes and modifications may be made in the embodiment without departing from the scope of the present invention.

For instance, in the second preferred embodiment, three or four paper discharge rollers are disposed. However, if five paper discharge rollers are disposed, one paper discharge roller is disposed at the center of the rotational shaft. And, the two discharge rollers having diameters smaller than that of the central paper discharge roller are respectively disposed on either side of the central paper discharge roller. Further, the two paper discharge rollers having the smallest diameter are respectively disposed at or near the end of the rotational shaft outwardly from the outer paper discharge. That is, paper discharge rollers are arranged on the rotational shaft such that the diameter of each paper discharge roller becomes smaller moving from the center to the outside of the shaft. Moreover, the length of the each rib which presses the paper against the paper discharge rollers becomes longer moving from the center to the outside of the shaft.

Further, in the second preferred embodiment, two ribs are disposed at any one position. However, it may be that one or more ribs may be disposed at any one position.

Figure 4:
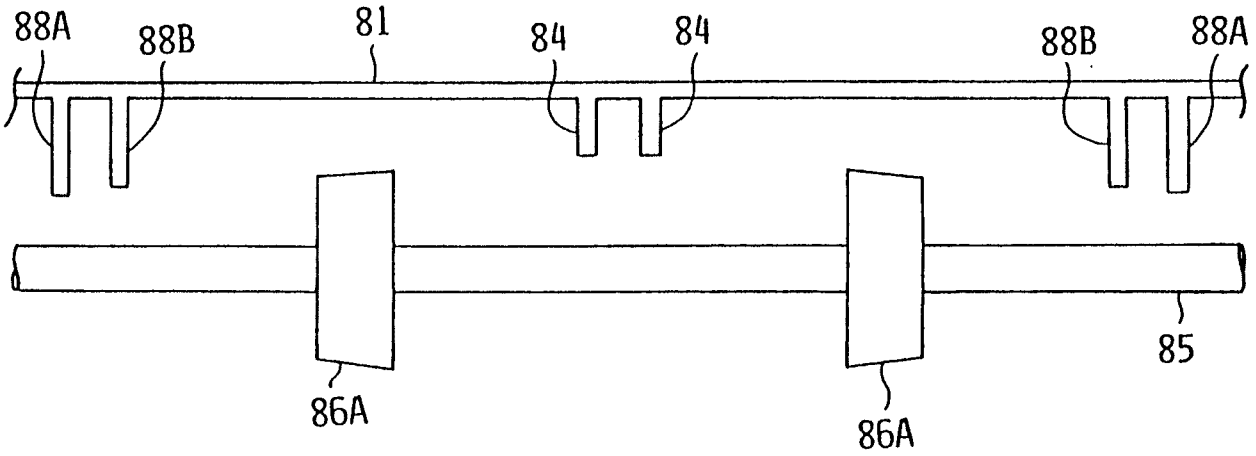
FIG. 4 is a front view of the paper discharge device of the third preferred embodiment of the present invention.

Moreover, in a third preferred embodiment, when a plurality of ribs are disposed at an outer position, as shown in FIG. 4, the length of the inside rib 88B may be shorter than that of the outside rib 88A.

Further, as shown in FIG. 4, the paper discharge roller 86A may be formed in the shape of a truncated cone. That is, the inside diameter of the paper discharge roller 86A is smaller than the outside diameter of the paper discharge roller 86A.

In the above-mentioned preferred embodiments, the paper discharge device is incorporated into the print device 50. However, the paper discharge device of the present invention can be incorporated into any device having a paper discharge portion.

I claim:

1. A paper discharge device for a print device, the print device ejecting a sheet of paper along a curved path leading to the paper discharge device, the curved path curving the sheet about a transverse dimension of the sheet, a center of curvature of the transverse curve located on a first side of the sheet, the paper discharge device comprising:

a rotational shaft;

at least three paper discharge rollers positioned axially along the rotational shaft, a diameter of at least one inner paper discharge roller being greater than a diameter of at least two outer paper discharge rollers; and a plurality of ribs attached to a rib panel pressing the sheet against the paper discharge rollers, the plurality of ribs and the paper discharge rollers seizing the sheet, wherein the sheet, as it is discharged from the print device, is curved by the paper discharge device about a longitudinal dimension of the sheet, a center of curvature of the longitudinal curve located on the first side of the sheet.

2. The paper discharge device of claim 1, wherein at least one rib is located on the rib panel centrally between each pair of adjacent discharge rollers.

3. The paper discharge device of claim 2, wherein the outer discharge rollers each have a trapezoidal cross-section, such that for each outer discharge roller an inward diameter of the outer discharge roller is greater than an outward diameter of the discharge roller.

4. The paper discharge device of claim 2, wherein at least two ribs are located on the rib panel between each pair of adjacent discharge rollers.

5. The paper discharge device of claim 4, wherein an outer one of each of the at least two ribs is greater in length than an inner one of each of the at least two ribs.

6. The paper discharge device of claim 4, wherein a first distance between each pair of adjacent ribs of the at least two ribs located between each pair of adjacent discharge rollers is less than second distances between the at least two ribs and each of the pair of adjacent discharge rollers.

7. The paper discharge device of claim 2, wherein a length of at least one central rib is less than a length of at least two outer ribs.

8. The paper discharge device of claim 1, wherein one of the discharge rollers is located on the rotational shaft centrally between each pair of adjacent ribs.

9. The paper discharge device of claim 1, wherein when a number of the discharge rollers is odd, an innermost one of discharge rollers contacts a generally central portion of the shut to be discharged.

10. The paper discharge device of claim 1, wherein when a number of the discharge rollers is even, at least an innermost one of the plurality of ribs contacts a generally central portion of the sheet to be discharged.

11. A paper discharge device for a print device, the print device ejecting a sheet of paper along a curved path leading to the paper discharge device, the curved path curving the sheet about a transverse dimension of the sheet, a center of curvature of the transverse curve located on a first side of the sheet, the paper discharge device comprising:

a rotational shaft;

at least three paper discharge rollers positioned axially along the rotational shaft and spaced apart at a predetermined interval; and a plurality of ribs capable of pressing the sheet against the discharge rollers as it is discharged, wherein a diameter of at least one inner discharge roller is greater than a diameter of each at least two outer discharge rollers, such that the sheet is curved by the paper discharge device about a longitudinal dimension of the sheet, a center of curvature of the longitudinal curve located on the first side of the sheet.

12. The paper discharge device of claim 11, wherein the rib is located on the rib panel centrally between each pair of adjacent discharge rollers.

13. The paper discharge device of claim 12, wherein the at least two outer discharge rollers each have a trapezoidal cross-section, such that for each outer discharge roller an inward diameter of the outer discharge roller is greater than an outward diameter of the discharge roller.

14. The paper discharge device of claim 12, wherein at least two ribs are located on the rib panel between each pair of adjacent discharge rollers.

15. The paper discharge device of claim 14, wherein a first distance between each pair of adjacent ribs of the at least two ribs located between each pair of adjacent discharge rollers is less than second distances between outer ones of the ribs and corresponding ones of the pair of adjacent discharge rollers.

16. The paper discharge device of claim 13, wherein an outer one of each of the at least two ribs is greater in length than an inner one of each of the at least two ribs.

17. The paper discharge device of claim 12, wherein a length of at least one central rib is less than a length of at least two outer ribs.

18. The paper discharge device of claim 11, wherein one of the discharge rollers is located on the rotational shaft centrally between each pair of adjacent ribs.

19. The paper discharge device of claim 11, wherein when a number of the discharge rollers is odd, an innermost one of discharge rollers contacts a generally central portion of the sheet to be discharged.

20. The paper discharge device of claim 11, wherein when a number of the discharge rollers is even, at least an innermost one of the plurality of ribs contacts a generally central portion of the sheet to be discharged.

21. A paper discharge device for a print device, the print device ejecting a sheet of paper along a curved path leading to the paper discharge device, the curved path curving the sheet about a transverse dimension of the sheet, a center of curvature of the transverse curve located on a first side of the sheet, the paper discharge device comprising:

a rotational shaft;

at least two paper discharge rollers positioned axially along the rotational shaft, each paper discharge roller having a trapezoidal cross section with an inward diameter of the discharge roller being greater than an outward diameter of the discharge roller; and a plurality of ribs attached to a rib panel pressing the sheet against the paper discharge rollers, the plurality of ribs and the paper discharge rollers seizing the sheet, wherein the sheet, as it is discharged from the print device, is curved by the paper discharge device about a longitudinal dimension of the sheet, a center of curvature of the longitudinal curve located on the first side of the sheet.

22. The paper discharge device of claim 21, wherein an outward diameter of each paper discharge roller is greater than an axially inward diameter of an adjacent outer paper discharge roller.

* * * * *